US006711789B2

(12) United States Patent
Ping

(10) Patent No.: US 6,711,789 B2
(45) Date of Patent: Mar. 30, 2004

(54) CLAMP

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 0 days.

(21) Appl. No.: 10/218,043

(22) Filed: Aug. 14, 2002

(65) Prior Publication Data

US 2004/0031131 A1 Feb. 19, 2004

(51) Int. Cl.[7] ..... A44B 21/00

(52) U.S. Cl. ..... 24/505; 24/499; 269/68; 81/319

(58) Field of Search ..... 24/499, 505, 508, 24/509, DIG. 13, 511, 326, 336, 67.5, 67.8, 545, 546; 269/2, 6, 68, 97; 81/302, 319–321, 337, 338

(56) References Cited

U.S. PATENT DOCUMENTS

| | | | | | |
|---|---|---|---|---|---|
| 544,268 | A | | 8/1895 | Unsinger et al. | |
| 1,110,220 | A | | 9/1914 | Millsap | |
| 1,181,654 | A | | 5/1916 | Eifel | |
| 1,445,348 | A | * | 2/1923 | Noble | 606/147 |
| 1,561,833 | A | * | 11/1925 | Cruickshank | 81/337 |
| 1,616,621 | A | | 2/1927 | Hooks | |
| 1,957,992 | A | | 5/1934 | Cohen | |
| 2,250,400 | A | | 7/1941 | Stephens | |
| 2,577,008 | A | * | 12/1951 | Engstrom | 606/201 |
| 2,959,993 | A | | 11/1960 | Freimark | |
| 3,038,467 | A | | 6/1962 | Sovatkin | |
| 3,157,075 | A | * | 11/1964 | Filia | 81/313 |
| 3,263,535 | A | | 8/1966 | Zurcher | |
| 3,470,872 | A | | 10/1969 | Grieschaber | |
| 3,604,071 | A | * | 9/1971 | Reimels | 24/543 |
| 3,779,108 | A | | 12/1973 | Rieter | |
| 4,153,321 | A | * | 5/1979 | Pombrol | 439/437 |
| 4,526,172 | A | * | 7/1985 | Stephenson | 606/208 |
| 4,538,485 | A | * | 9/1985 | Saila | 81/336 |
| 4,794,780 | A | | 1/1989 | Battenfeld | |
| 4,835,824 | A | * | 6/1989 | Durham et al. | 24/339 |
| 5,022,126 | A | * | 6/1991 | Davis | 24/543 |
| 5,022,291 | A | | 6/1991 | McBain | |
| D323,588 | S | | 2/1992 | Pelosi | |
| 5,143,359 | A | | 9/1992 | Bush | |
| 5,152,095 | A | | 10/1992 | Combs, III | |
| D335,249 | S | | 5/1993 | Hopkins | |
| 5,207,030 | A | | 5/1993 | Herrmann | |
| 5,255,579 | A | | 10/1993 | Fortin | |
| D350,892 | S | | 9/1994 | Sorensen | |
| D356,477 | S | | 3/1995 | Everhardt | |
| 5,626,608 | A | * | 5/1997 | Cuny et al. | 606/205 |
| 5,767,416 | A | | 6/1998 | Conard | |
| 5,791,210 | A | | 8/1998 | Wolff | |
| D399,729 | S | | 10/1998 | Chen | |
| 5,843,125 | A | | 12/1998 | Jempolsky | |

(List continued on next page.)

*Primary Examiner*—Anthony Knight
*Assistant Examiner*—André L. Jackson
(74) *Attorney, Agent, or Firm*—Joseph J. Previto

(57) ABSTRACT

A clamp having first and second handle assemblies with each handle assembly having a jaw, a hand grip and an intermediate portion. The handle assemblies are pivotally mounted to each other at their intermediate portions for movement between an open position and a predetermined closed position. A spring is provided for biasing the hand grips and jaws to an open position. A locking mechanism is provided to lock the jaws in the predetermined closed position. The locking mechanism comprises a rack mounted on one of the hand grips and a pawl mounted on the other hand grip, each of which have teeth adapted to mesh with each other to hold the jaws in the predetermined closed position. Mechanism is also provided to release the pawl teeth from the rack teeth to permit the jaws and hand grips to move to an open position.

10 Claims, 4 Drawing Sheets

U.S. PATENT DOCUMENTS

| | | | | | |
|---|---|---|---|---|---|
| 5,991,997 | A | | 11/1999 | Schley | |
| 6,092,460 | A | * | 7/2000 | Engelhardt | 99/495 |
| D430,782 | S | | 9/2000 | Renner | |
| 6,112,650 | A | | 9/2000 | Mazzaccaro | |
| D433,318 | S | | 11/2000 | Chang | |
| 6,212,977 | B1 | | 4/2001 | Liou | |
| 6,220,126 | B1 | | 4/2001 | Domenge | |
| D442,047 | S | | 5/2001 | Hicks | |
| 6,240,815 | B1 | | 6/2001 | Huang | |
| 6,276,039 | B1 | | 8/2001 | Barnes | |
| 6,315,780 | B1 | * | 11/2001 | Lalonde | 606/86 |
| 6,336,386 | B1 | | 1/2002 | Lee | |
| 6,378,404 | B1 | * | 4/2002 | Bally et al. | 81/355 |

* cited by examiner

CLAMP

BACKGROUND

The present invention relates to a clamp and more particularly to an improved clamp in which the jaws can be easily locked in a predetermined position around an article and in which the jaws can be easily unlocked from said predetermined position to release the article.

A number of clamps have been used in the past to hold articles. Some of these clamps have means for locking the jaws of the clamp in a predetermined gripping position around an article and for unlocking them to release the article. Some of these previous clamps are complicated to operate as well as expensive to manufacture and maintain.

Objects

The present invention avoids these drawbacks and has for one of its objects the provision of an improved clamp in which the jaws can be easily locked in a predetermined position around an article and in which the jaws can be easily unlocked to release the article.

Another object of the present invention is an improved clamp which is simple to operate and maintain.

Another object of the present invention is an improved clamp which is inexpensive to manufacture and maintain.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
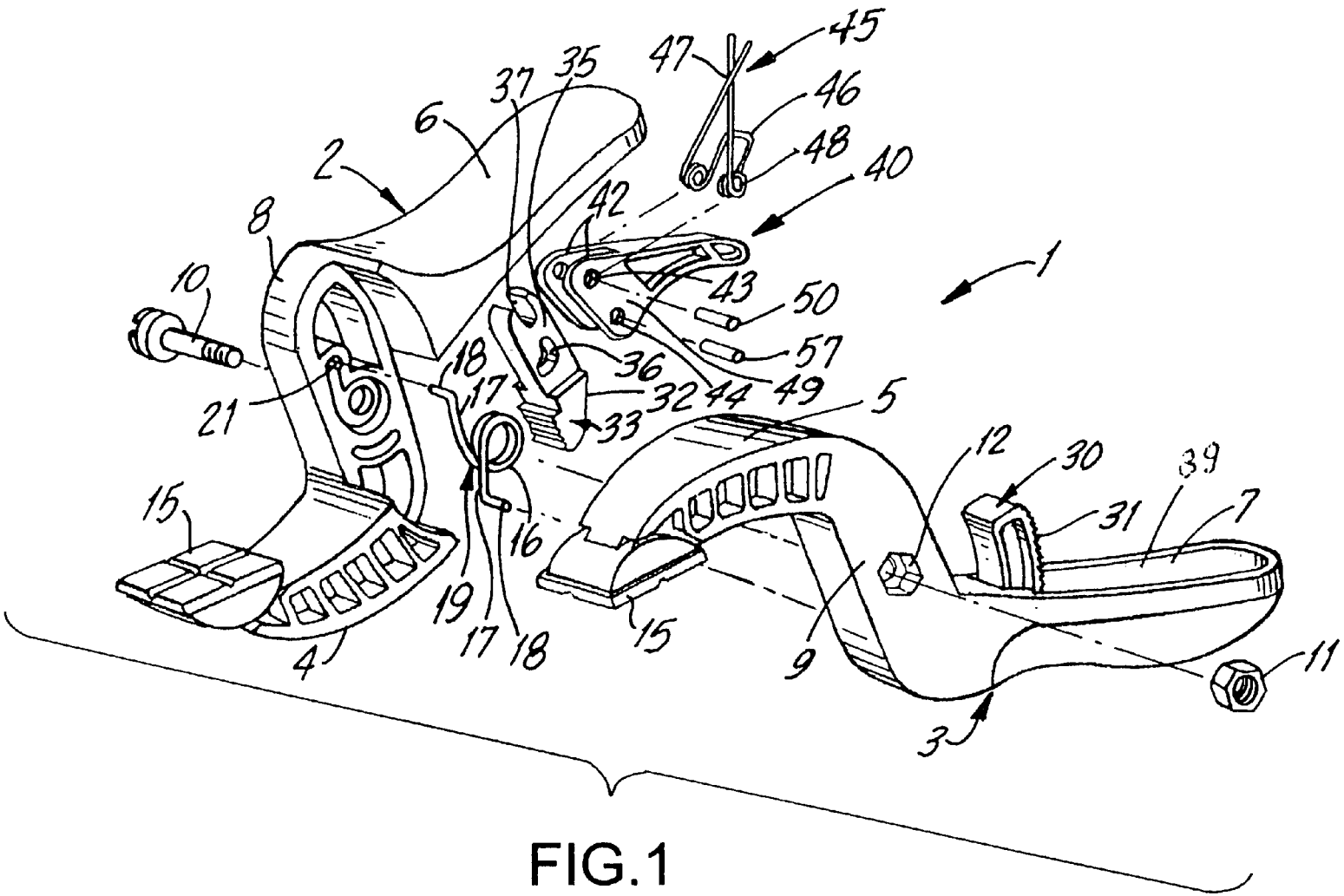
FIG. 1 is an exploded perspective view showing the various parts of the clamp of the present invention.
Figure 2:
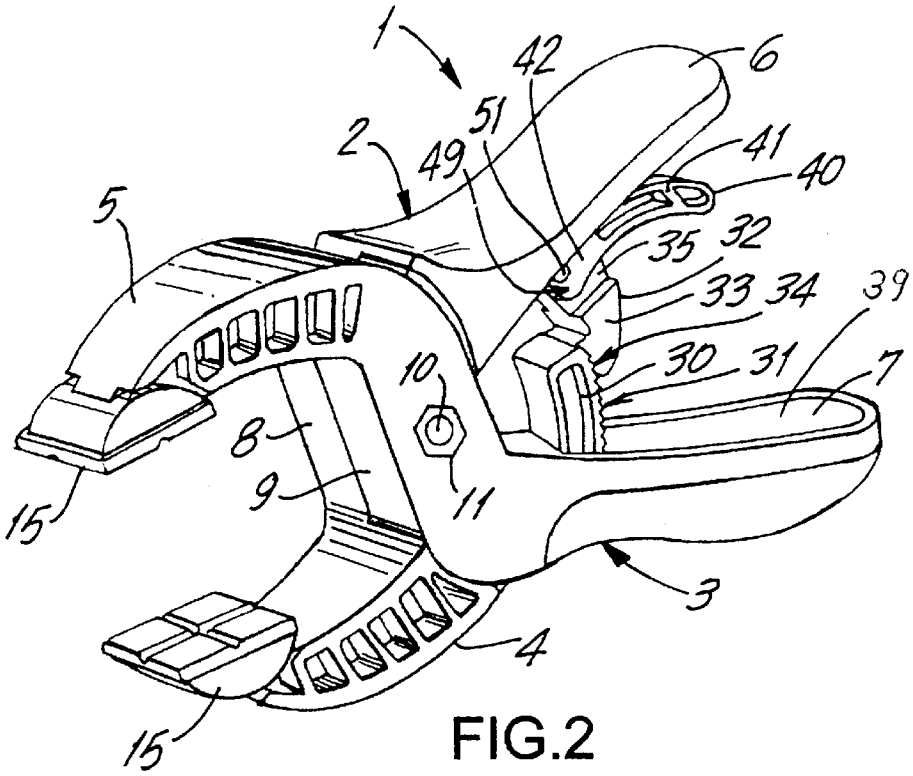
FIG. 2 is a perspective view of the clamp in its open position
Figure 3:
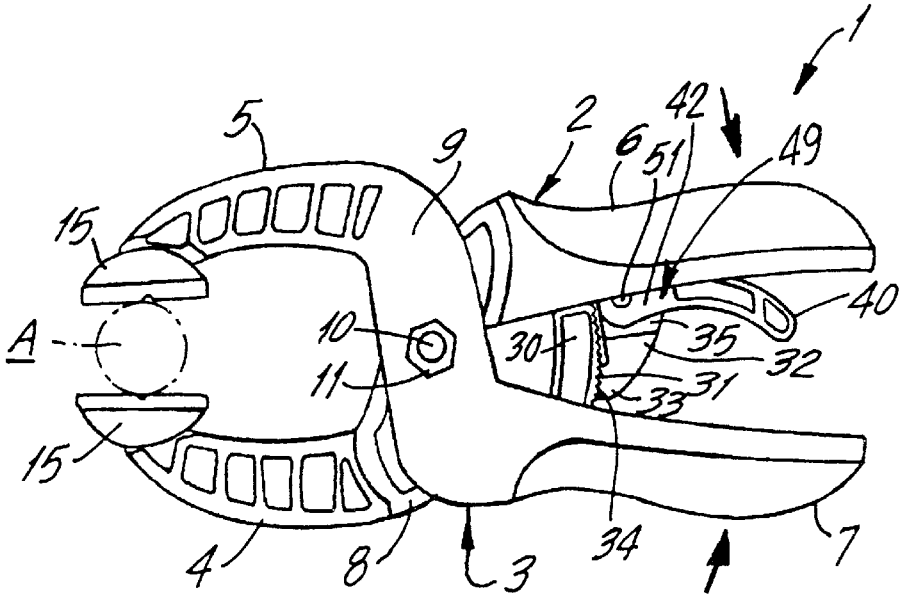
FIG. 3 is a plan view showing the clamp locked in position to hold an article.
Figure 4:
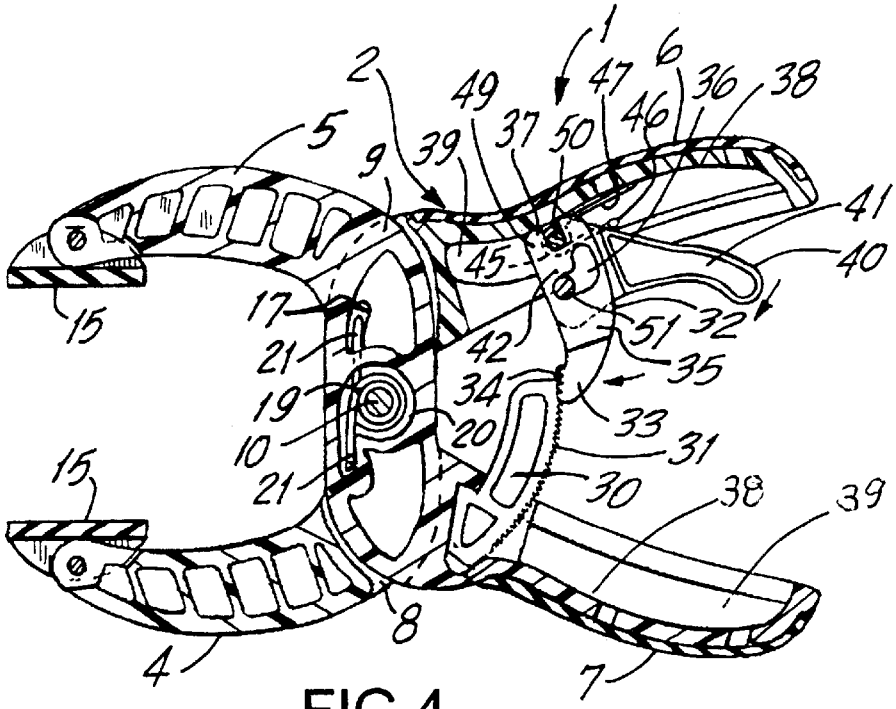
FIG. 4 is a sectional view showing the clamp in its open position.
Figure 5:
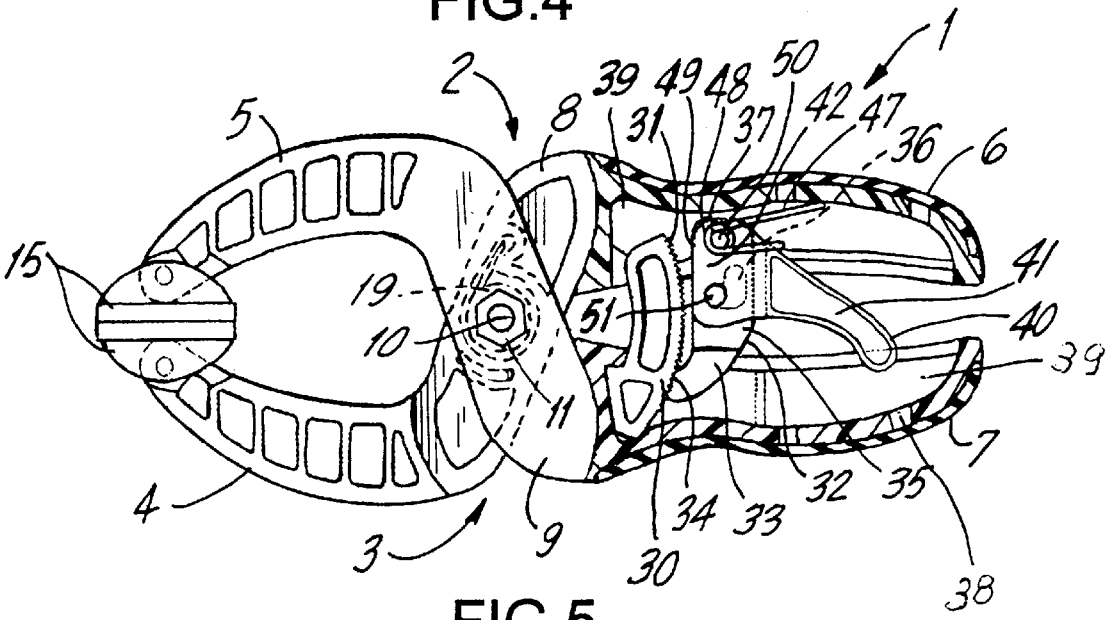
FIG. 5 is a sectional view showing the clamp in its closed position.
Figure 6:
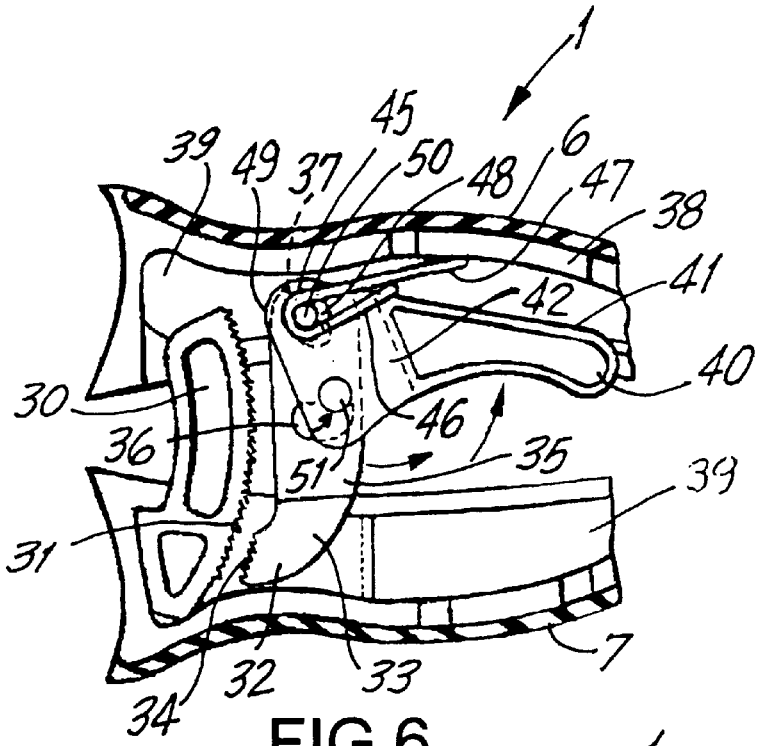
FIG. 6 is a sectional view detail showing the manner of unlocking the jaws.
Figure 7:
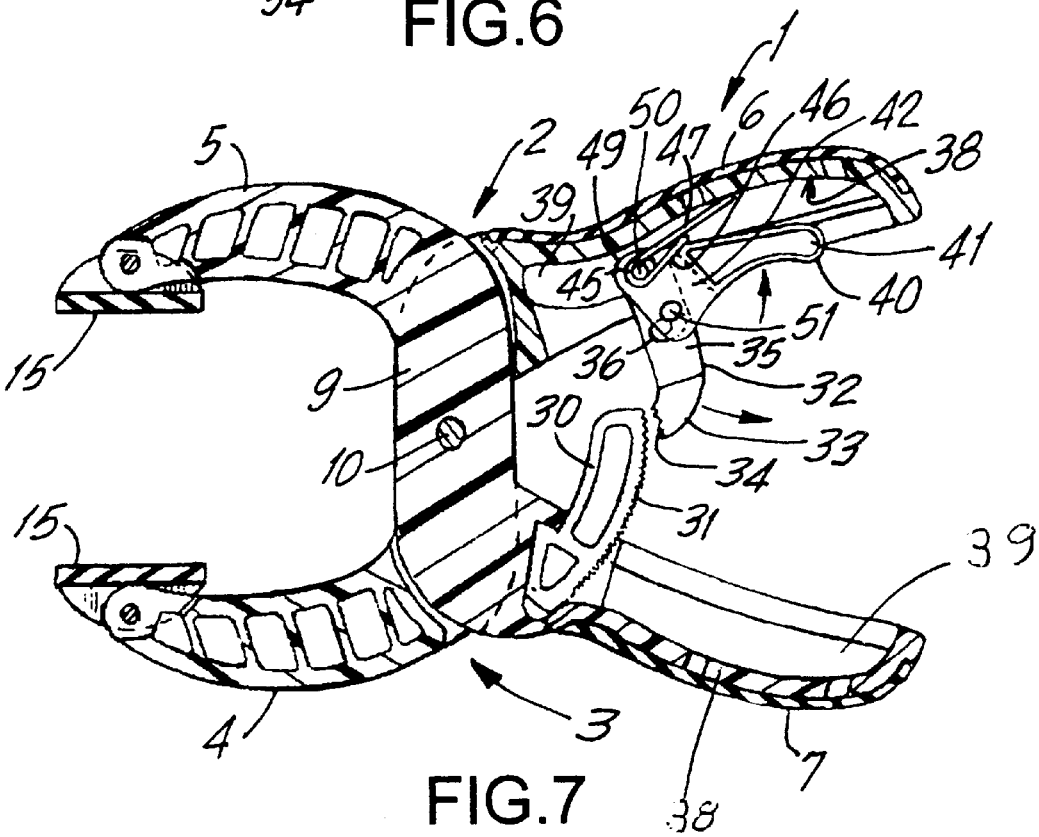
FIG. 7 is a sectional view showing the jaws in an open position.

With specific reference to the drawings, the clamp 1 of the present invention comprises a pair of one piece first and second handle assemblies 2 and 3 each having, respectively, a jaw 4 and 5, a hand grip 6 and 7 and an intermediate portion 8 and 9, which connect hand grip 6 and jaw 4 together and hand grip 7 and jaw 5 together, respectively. Each of the hand grips 6 and 7 is preferably hollow with the hand grips 6 and 7 each having spaced inner side walls 39 and a base 38. The handle assemblies 2 and 3 are pivotally mounted to each other at their intermediate portions 8 and 9 by means of a pivot pin 10 and nut 11 extending through openings 12 in said intermediate portions 8 and 9. The handle assemblies 2 and 3 cross each other at the pivot pin 10 so that where the hand grips 6 and 7 are moved together the jaws 4 and 5 are moved together and when the hand grips 6 and 7 are moved apart, the jaw 4 and 5 will move apart. Each of the jaws 4 and 5 has a grip pad 15 pivotally mounted to the end of each jaw 4 and 5 which are adapted to grip an article A therebetween (FIG. 3). Mounted around the pivot pin 10 is a spring assembly 19 comprising a coiled head portion 16 wound around pivot pin 10, legs 17 extending from the head portion 16 and lock pins 18 bent at an angle to the legs 17. The spring assembly 19 is adapted to fit in a cavity 20 provided in each of the intermediate portions 8 and 9 with the bent legs 17 extending into holes 21 in each of the intermediate portions 8 and 9. The legs 17 of the spring assembly 19 are biased to exert outward pressure on the handle assemblies 2 and 3 to bias the jaws 4 and 5 and hand grips 6 and 7 of the handle assemblies 2 and 3 in an open position and permits the jaws 4 and 5 and hand grips 6 and 7 of the handle assemblies 2 and 3 to be moved toward each other against the bias of the spring assembly 19.

Releasable locking means are provided in the hollow hand grips 6 and 7 which cooperate with each other to hold the jaws 4 and 5 in an open position. The hand grip 7 of the second handle assembly 3 is provided with a curved toothed rack 30 between its side walls 39 extending from its base 38 and having a plurality of teeth 31 thereon. The hollow hand grip 6 of the first handle assembly 2 has a pawl 32 and a spring pressed trigger assembly 40 mounted thereon. The pawl 32 has a head 33 having a plurality of teeth 34 and a tail 35 having an arcuate slot 36 and an open end groove 37. The pawl 32 is mounted in the trigger assembly 40 which includes a finger portion 41 and a body 49 comprising spaced plates 42. Each of the spaced plates 42 have spaced openings 43 and 44 with the openings 43 and 44 of one plate 42 being aligned with the openings 43 and 44 of the other plate 42. The tail 35 of the pawl 32 is inserted between the spaced plates 42 of the trigger assembly 40 so that the open end groove 37 and arcuate slot 36 in the tail 35 are aligned with the openings 43 and 44, respectively, in the spaced plates 42. A spring 45 having a coiled head 48 with legs 46 and 47 extending therefrom is mounted over the space plates 42 so that the head 48 is in alignment with spaced plate openings 43 and open end groove 37 in tail 35 of pawl 32. A pin 50 is inserted through the head 48, openings 43 one open end groove 37 and is attached by any well known means to the inner opposed side walls 39 of the hollow hand grip 6 so that pin 50 holds the pawl 32, trigger assembly 40 and spring 45 together and permits the trigger assembly 40 to pivot relative to the hand grip 6 and pawl 32. Another pin 51 is mounted in the second openings 44 in the spaced plates 42 and extends through the arcuate slot 36 in the tail 35 to limit the movement of the trigger assembly 40 relative to the pawl 32 to the confines of the arcuate slot 36. The leg 47 of the spring 45 is mounted against the base 38 of the hollow hand grip 6 and the leg 46 of the spring 45 is mounted between spaced plates 42 so that the spring 45 exerts an outward bias on the finger assembly 40 to push and bias the pawl 32 outwardly toward the rack 30. When the finger piece 41 is pressed inwardly toward the hollow hand grip 6 by the user, the pawl 32 will move inwardly away from the rack 30 against the bias of the spring 45. When the finger piece 40 is released, the spring assembly 45 will force the finger 40 and the pawl 32 outwardly toward the rack 30.

With this structure, the jaws 4 and 5 are moved together by compressing the hand grips 6 and 7 toward each other against the bias of spring 19 until the grip pads 15 grasp and hold an article A therebetween. The teeth 34 of the pawl 32 move along the teeth 31 of the rack 30 and since the pawl 32 is biased toward the rack 31, when the article gripping position is reached the teeth 34 of the pawl 32 will enter and mesh with the teeth 31 in the rack 30 to lock the jaws 4 and 5 in the article holding position. When it is desired to release the article A, the finger piece 41 is pressed inwardly by the user against the action and bias of the spring 45 to move the teeth 34 of the pawl 33 away from the teeth 31 of the rack 30, hence permitting the spring assembly 19 to automatically open the hollow handle grips 6 and 7 and the jaws 4 and 5 thereby releasing the article A from between the grip pads 15.

It will then be seen that the present invention provides an improved clamp in which the jaws can be easily locked into a predetermined position around an article, in which the jaws can be easily unlocked to release the article, which is simple to operate and maintain and which is inexpensive to manufacture and maintain.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or the Privilege is claimed are defined as follows:

1. A clamp comprising first and second handle assemblies, each handle assembly having a jaw, a hand grip and a intermediate portion, said handle assemblies being pivotally mounted to each other at their intermediate portion for movement between and open position and a predetermined closed position, means for biasing the hand grips and jaws to said open position, locking means to lock said jaws in said predetermined closed position, said locking means comprises a rack mounted on one of said hand grips and pawl mounted on the other hand grip, said pawl and said rack having teeth adapted to mesh with each other to hold the jaws in said predetermined closed position means to release said pawl teeth from rack teeth to permit the jaws and hand grips to move to an open position, means are provided to move said pawl toward said rack to cause the pawl teeth and the rack teeth to mesh with each other, said release means comprised means from moving the pawl away from said rack, a trigger assembly is pivotally mounted on said other grip and said pawl is connected to said trigger assembly, said trigger assembly is pivotally connected to said pawl.

2. A clamp as set forth in claim 1, wherein movement of said trigger assembly toward said hand grip will move the pawl away from said rack and movement of the trigger assembly away from said hand grip will move the pawl toward said rack.

3. A clamp as set forth in claim 2, wherein spring means are provided to bias the trigger assembly away form the hand grip to move the pawl toward the said rack.

4. A clamp as set forth in claim 3, wherein said pawl has an open end groove and wherein said trigger assembly is pivotally connected to said open end groove.

5. A clamp as set forth in claim 4, wherein said pawl has a arcuate slot and wherein said trigger assembly has means extending into said arcuate slot to limit its movement relative to the pawl.

6. A clamp as set forth in claim 5, wherein said trigger assembly comprises a finger portion and a body portion comprising spaced plates and wherein a pivot means connects said spaced plates to said outer open end groove in the pawl.

7. A clamp as set forth in claim 6, wherein said pivot means comprises a pin and wherein spring means are mounted on said pin, said spring adopted to bias the finger portion away from the said other handle.

8. A clamp as set forth in claim 7, wherein said other hand grip is hollow with side walls and a base and wherein said pivot means is mounted on said side walls.

9. A clamp as set forth in claim 8, wherein said spring means is mounted between said finger portion and said base in order to bias the finger portion away from the other hand grip.

10. A clamp as set forth in claim 9, wherein spring means are mounted at the pivot between said handle members in order to bias the handle members to an open position.

* * * * *